US007316280B2

(12) United States Patent
Völkel

(10) Patent No.: US 7,316,280 B2
(45) Date of Patent: Jan. 8, 2008

(54) METHOD FOR PRODUCING EARTH BOREHOLES

(75) Inventor: Gerhard Völkel, Erndtebruck (DE)

(73) Assignee: Tracto-Technik GmbH, Lennestadt (DE)

( * ) Notice: Subject to any disclaimer, the term of this patent is extended or adjusted under 35 U.S.C. 154(b) by 151 days.

(21) Appl. No.: 10/483,319

(22) PCT Filed: Jul. 11, 2002

(86) PCT No.: PCT/EP02/07746

§ 371 (c)(1),
(2), (4) Date: May 21, 2004

(87) PCT Pub. No.: WO03/006786

PCT Pub. Date: Jan. 23, 2003

(65) Prior Publication Data

US 2004/0188144 A1 Sep. 30, 2004

(30) Foreign Application Priority Data

Jul. 12, 2001 (DE) ..... 101 34 036
Dec. 5, 2001 (DE) ..... 101 59 712

(51) Int. Cl.
*E21B 19/08* (2006.01)
*E21B 7/00* (2006.01)

(52) U.S. Cl. ..... 175/62; 175/122; 175/162

(58) Field of Classification Search ..... 405/138, 405/184, 184.5; 175/62, 52, 85, 51, 87, 103, 175/315, 122, 162; 173/185, 186
See application file for complete search history.

(56) References Cited

U.S. PATENT DOCUMENTS 2,026,627 A * 1/1936 Gilman ..... 175/85
2,614,807 A * 10/1952 Curtis ..... 248/647
3,411,596 A * 11/1968 Robbins ..... 175/85
3,568,779 A * 3/1971 Cannon ..... 173/44
3,902,561 A * 9/1975 Friberg et al. ..... 175/52
3,961,673 A * 6/1976 Wolters et al. ..... 175/52

(Continued)

FOREIGN PATENT DOCUMENTS

DE 42 32 949 A1 4/1994

(Continued)

OTHER PUBLICATIONS

Wehefritz, Kurt, W., "Trenchless Laying is the Future," s+t 46, Fachbeitrag/Horizontal-Spulbohrtechnik (1992).

*Primary Examiner*—Kenneth Thompson
(74) *Attorney, Agent, or Firm*—Cook, Alex, McFarron, Manzo, Cummings & Mehler, Ltd.

(57) ABSTRACT

In a method for producing and widening ground bores or for the destructive replacement of buried lines with the aid of a tool arranged at the end of a rod driven by a boring device, the rod is built up from individual sections which are to be connected to one another in a machine excavation (staring excavation). In order to allow the use even of rod sections whose length is equal or almost equal to the diameter of the machine excavation, the boring device, prior to the introduction of a new rod section, is displaced, for example inclined, in such a manner that the rod section can be slid into the boring device, for example from outside the excavation, without interference from the rear end, projecting into the machine excavation, of a rod section which has already been introduced into the ground. As soon as the rod section has been slid in, the boring device together with the rod section is moved into a position in which it is aligned with the boring direction or the rod part which is already in the ground.

7 Claims, 6 Drawing Sheets

U.S. PATENT DOCUMENTS

Figure 1:
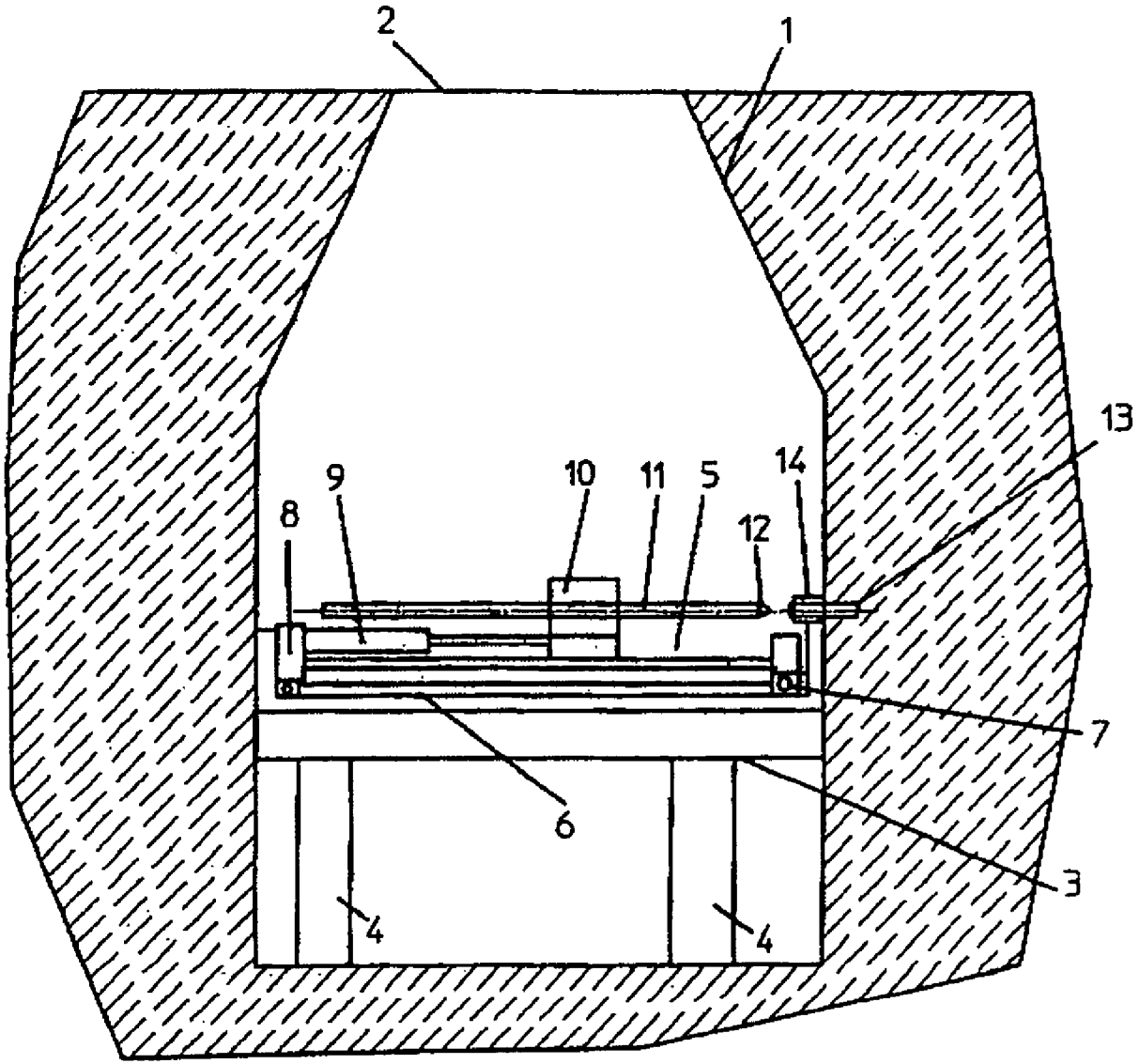

| | | | | |
|---|---|---|---|---|
| 4,595,065 | A * | 6/1986 | Wada et al. | 175/85 |
| 4,691,788 | A | 9/1987 | Yoshida et al. | |
| 5,129,764 | A * | 7/1992 | Casagrande | 405/303 |
| 6,068,426 | A | 5/2000 | Blanquet et al. | |

FOREIGN PATENT DOCUMENTS

| | | | |
|---|---|---|---|
| DE | 195 06 337 | C1 | 3/1996 |
| DE | 195 27 138 | C1 | 7/1996 |
| DE | 195 12 076 | A1 | 10/1996 |
| DE | 196 33 934 | A1 | 2/1998 |
| DE | 195 38 557 | C2 | 10/1998 |
| DE | 196 12 902 | C2 | 5/2000 |
| EP | 0 167 979 | A1 | 1/1986 |
| EP | 02213584 | | 8/1990 |
| GB | 2 264 736 | A | 9/1993 |
| JP | 81 99 960 | | 8/1996 |
| WO | PCT/EP02/07746 | | 11/2002 |
| WO | PCT/EP02/07746 | | 10/2003 |

* cited by examiner

METHOD FOR PRODUCING EARTH BOREHOLES

The invention relates to a method for producing and widening ground bores or for the destructive replacement of lines which have been laid in the ground, and invokes the priorities of German patent applications 101 34 036.2 and 101 59 712.6-24, to the content of which reference is made.

Methods of this type generally use a boring device which is suitable for horizontal boring and has a rod, at the free end of which a tool is suitable for boring and/or widening in the ground or for destroying an old pipe which has been laid in the ground. The rod comprises individual sections which are screwed together or are fitted and screwed to the rear end of the rod part which is already in the ground. However, this fitting and screwing operation encounters difficulties, since the boring device must be located at the level of the ground bore or of the old pipe and accordingly is usually arranged in a starting excavation, i.e. in an excavation which has previously been dug or in an existing manhole of a sewerage system.

The total length of the rod section and of the boring device may correspond to at most the diameter of the manhole or of the manhole opening, so that there is still space behind the boring device for a rod section to be pushed axially into the boring device in order for a new rod section to be connected to the rod part which is already in the ground, after which operation of the boring device recommences in order to introduce the rod section which has been fitted. Given a distance of up to 60 m between the manholes and a standard manhole diameter of 100 to 120 cm, and at most 160 cm, this means that introducing a rod section over the entire distance entails a considerable outlay on time.

Moreover, on account of the shortness of the rod sections, a large number of—for example 60 or 70—expensive socket or screw connections which are susceptible to faults are required. An additional factor is that with pneumatically driven boring devices there are starting difficulties if the length of hose running from a compressor to the boring device exceeds a certain level.

The abovementioned problems occur both if a new ground bore is produced between manholes and a new pipeline is introduced and if an old pipeline which is destroyed by a cutting tool on the rod in order for a new pipeline subsequently to be introduced is present between the manholes.

In the case of boring with a boring device arranged in an excavation which has been dug, the same difficulties arise if the excavation is of approximately the same width as a standard manhole; they can be eliminated or alleviated if the clear width is (considerably) larger. However, this requires a correspondingly increased amount of earth to be excavated and therefore entails increased costs. Moreover, it presents problems on account of the need to temporarily store or transport away the soil which has been excavated.

The journal "s+t46 (1992)11", pages 10, 12, 14, has also already disclosed a method for the trench-free laying of supply lines in which first of all two excavations, i.e. a starting excavation and a target excavation, are dug. Then, a boring device which is located above the ground and works obliquely creates an inclined bore with respect to the starting excavation and then a substantially horizontal bore leading to the target excavation. Then, the boring rod is provided in the target excavation with a widening head which works in the opposite direction and is finally pulled back until it reaches the starting excavation.

However, it is often not acceptable or highly complex to produce an auxiliary bore, requiring subsequent closure of the auxiliary bore and restoration of the hole wall and of the surrounding surface finish (road surfacing, forecourt plants, etc.).

Therefore, the invention is based on the problem of avoiding the drawbacks which result from the limited length of the rod sections or the need to dig out an excavation with a diameter which is suitable for longer rod sections or to produce and then eliminate an auxiliary bore.

To avoid these drawbacks, the invention proposes a method in which the component which receives the rod sections (i.e. the rod receiving part) or the entire boring device is first of all moved into a spatial position which allows the rod sections to be introduced into the rod receiving part without being impeded by the rear end, projecting into the machine excavation, of a rod section which has already been introduced into the ground. As soon as this has taken place, the rod receiving part or the boring device is moved back into the boring position, i.e. flush with the bore or that part of the rod which is already in the ground, where it is connected to the last rod section of the rod part which is already in the ground.

In the present context, the term rod receiving part is to be understood as meaning that part of a boring device which on one side is connected to the boring drive and on the other side receives the rear end of a rod section before this rod section is connected to the previous rod section. A rod receiving part of this type, in the form of a plug coupling, is described in German patent 197 25 628 and the corresponding U.S. Pat. No. 6,267,187.

To introduce a rod section, it is sufficient for the receiving part for the rod section, for example a coupling on the rotary drive for the rod, to be moved out of its boring position, for example to be displaced upward.

The change in position of a standard boring device can also be effected by pivoting between the boring position and the receiving position. Another possible option consists in moving the receiving part for the rod sections or the boring device between the two positions with the aid of a raising carriage or a type of lifting platform, which enable the rod sections to be introduced into the device above the boring level, for example at ground level.

In the case of pivoting, it is possible to use a boring device which is provided with at least one pivot bearing at the front or the rear, as seen in the boring direction. A device of this type may comprise a basic frame and a mounting which is arranged pivotably thereon and includes the actual boring device. In this case, a pivot drive, for example a hydraulic or pneumatic cylinder, is located between the basic frame and the mounting. Furthermore, the basic frame and the mounting may be provided with a locking mechanism which secures the boring device so as to prevent undesired movements during boring.

However, the basic frame may also serve as a lifting platform or be arranged on a lifting platform, by means of which the device is moved out of the boring position of variable height to the ground level, in order for a new rod section to be pushed in at that level or—in a target excavation—to be removed.

Use of the apparatus according to the invention results in the advantage that the pipe sections, in order to be pushed into the boring device or to be removed, do not require any additional space in an existing manhole or in a starting excavation which has been dug out; therefore, they may have a length which corresponds to the hole diameter or to the length of the boring device. On the other hand, when the apparatus according to the invention is used, there is no need for the dimension of the machine excavation in the horizontal direction to be any greater than approximately the length of the boring device.

Figure 2:
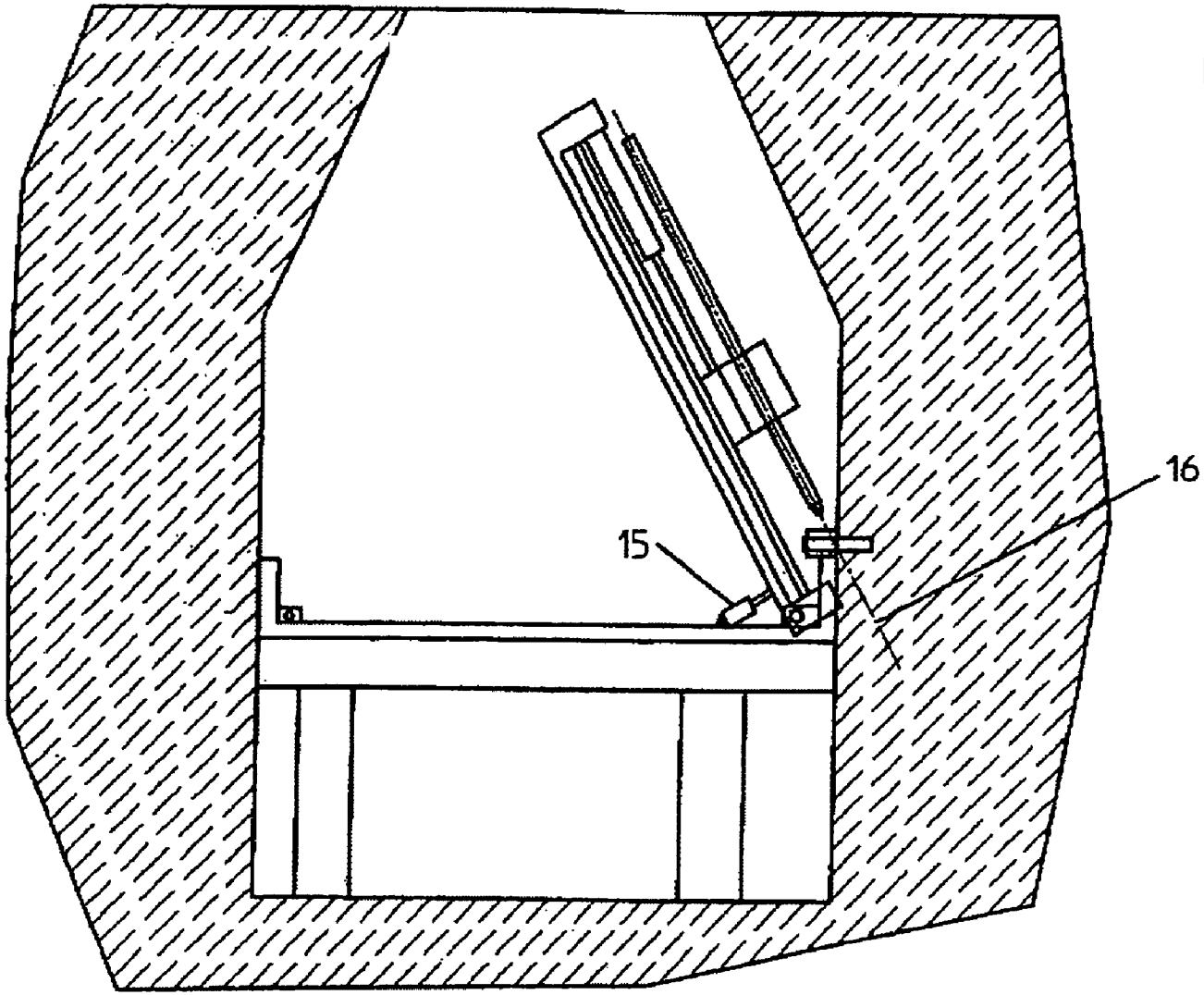
Figure 3:
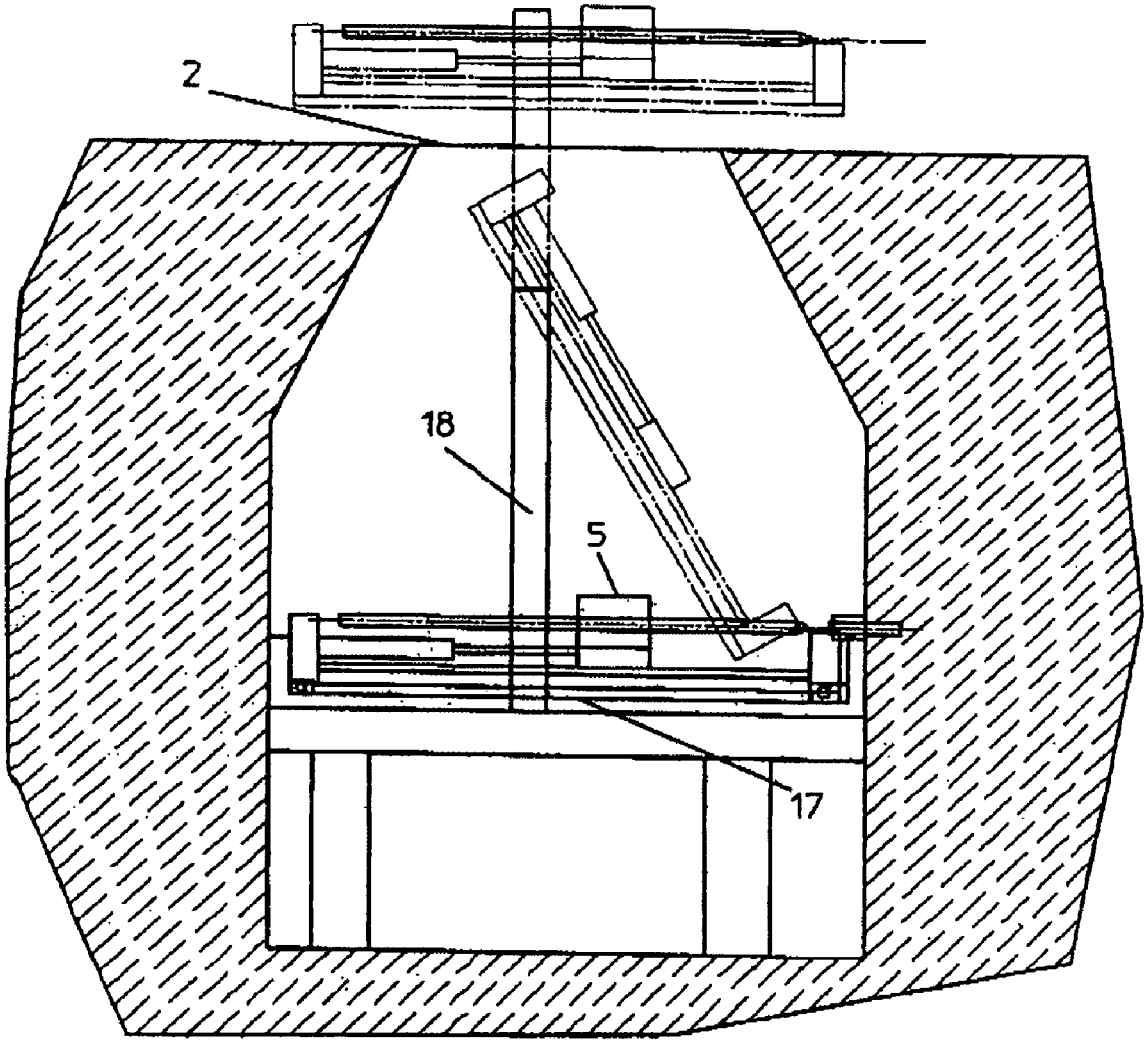
Figure 4:
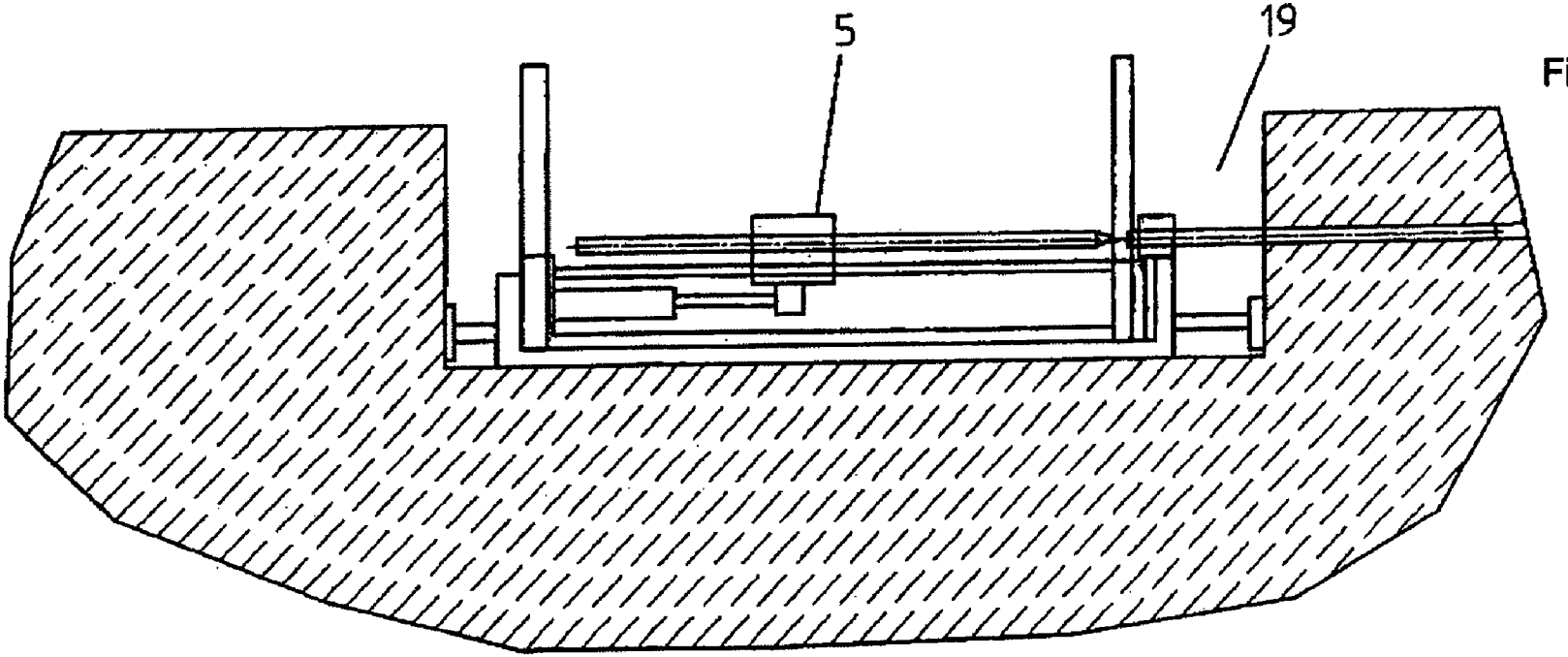
Figure 5:
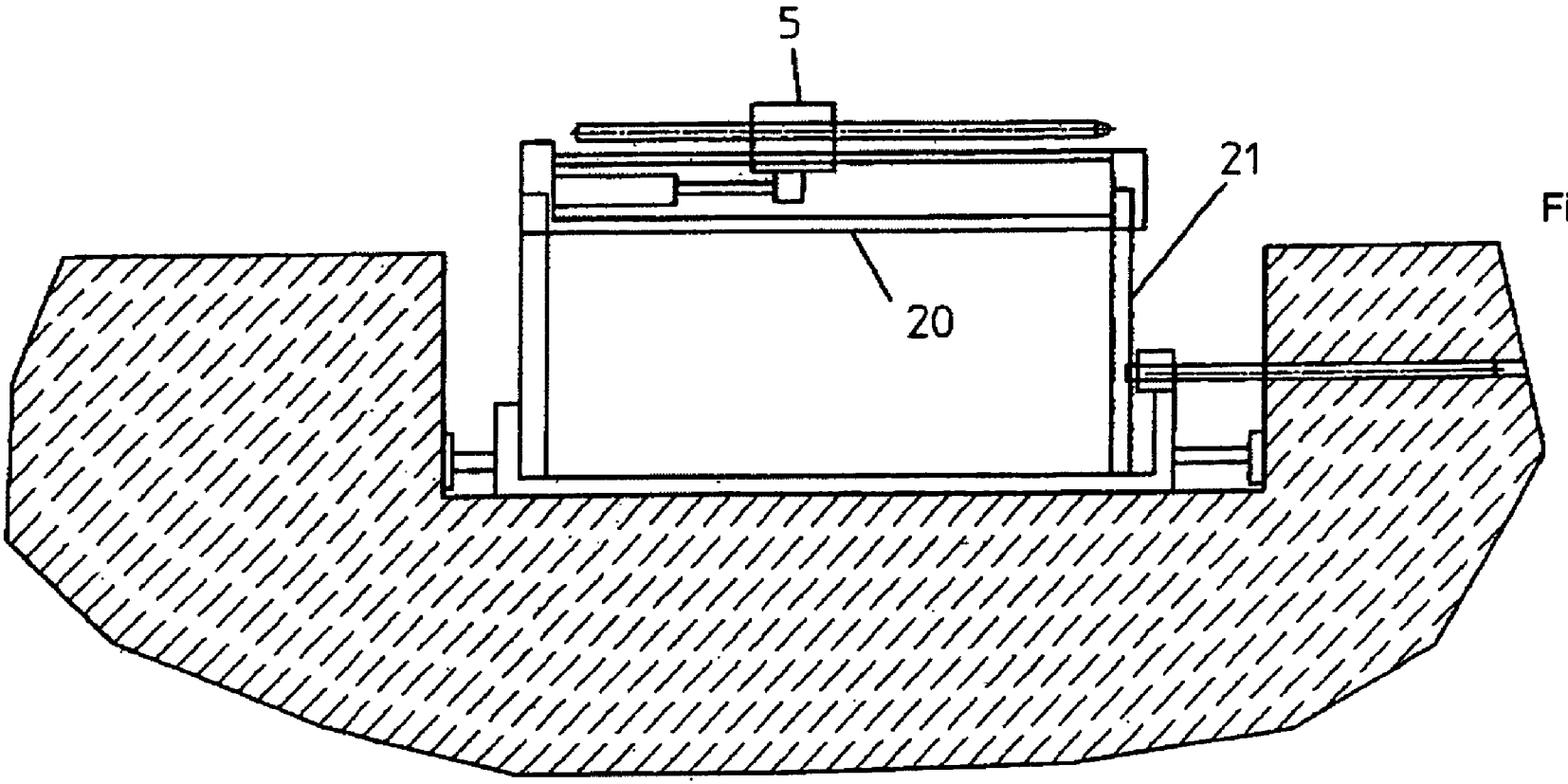
Figure 6:
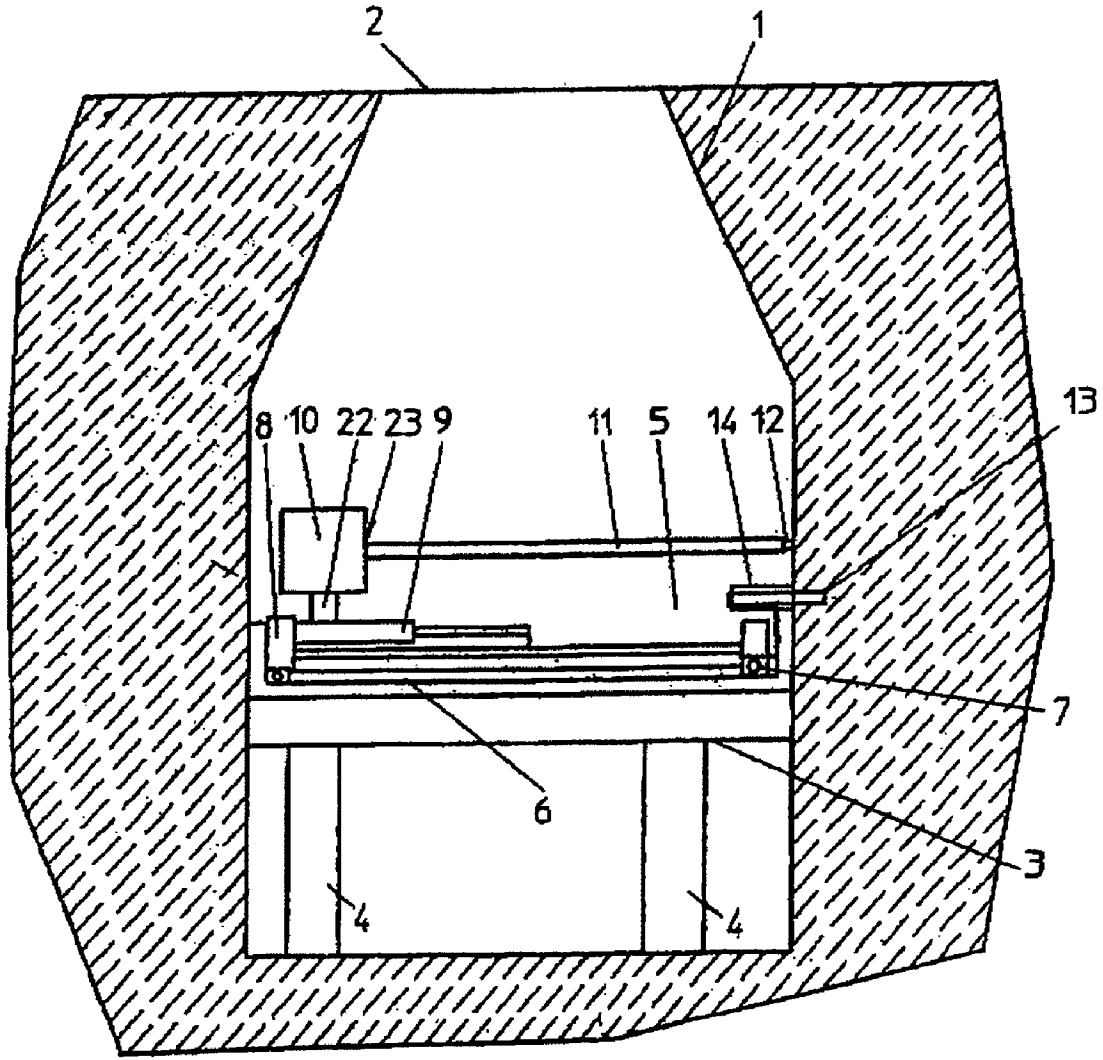

The invention is explained in more detail below with reference to two exemplary embodiments. In the drawing:

FIG. 1 shows a boring device according to the invention in its boring position in an existing manhole, FIG. 2 shows the device shown in FIG. 1 in its receiving position, FIG. 3 shows a boring device arranged pivotably on a raising carriage in three different height positions, FIG. 4 shows a boring device on a lifting platform in its boring position, and FIG. 5 shows a boring device shown in FIG. 3 in its receiving position above ground, and FIG. 6 shows a boring device, the rotary drive of which is vertically displaceable.

In a standard manhole 1 (machine excavation/target excavation) with a narrowed opening 2, there is a platform 3 on supports 4 bearing a boring device 5. The boring device comprises a basic frame 6, which is connected, via a pivot bearing 7, to a mounting 8, on which an advancing drive 9 and a rotary drive 10 are positioned. The advancing drive may also be arranged on the basic frame 6. The rotary drive 10 has a hollow shaft (not shown) which is such that it is able to receive a pipe section 11, the front end 12 of which can be screwed to the last rod section 13 of that part of the rod which is already in the ground. To allow this to occur, a clamping device 14 for holding the rod section 13 in place is located on the mounting 8. Force is transmitted between the hollow shaft and the rod section 11 by means of a positive lock or frictional lock.

As soon as the rod section 11 has been screwed to the rod section 13, the advancing drive 9 forces the rod 11, 13 into the ground until the rear end of the rod section 11 is in the situation of the rod section 13 and the mounting 8 has been "emptied". Then, the mounting 8 is pivoted out of the boring position illustrated in FIG. 1 into the receiving position illustrated in FIG. 2. This is preferably effected with the aid of a hydraulic cylinder 15 extending between the basic frame of the mounting until the mounting 8 has adopted a position in which the extension of the hollow shaft axis 16 extends within the opening 2 of the manhole 1. In this position, it is readily possible for a rod section 11 with a length of approximately the whole diameter to be introduced into the hollow shaft until it has reached the position illustrated in FIG. 2. Then, the mounting together with the new rod section can readily be pivoted back out of this position into the boring position illustrated in FIG. 1.

In the exemplary embodiment shown in FIG. 3, the boring device 5 is arranged on a raising carriage 17. The raising carriage can be displaced in a framework 18 arranged in the manhole 1 and is connected to a pivoting drive (not shown), for example a hydraulic cylinder, which allows the boring device to be arranged in an inclined position. In this way, it is possible to move a boring device through the narrowed hole opening 2 in the inclined position and thereby to move it into an above-ground receiving position, even if its length is greater than the clear width of the hole opening 2. As soon as the boring device 5 has reached its upper position in FIG. 3, it is pivoted back into a horizontal position in order to receive a rod section.

The boring device 5 shown in FIGS. 4 and 5, which is used in a dug-out machine or starting excavation 19, is situated on a lifting platform 20 which can be displaced, between supports 21, between the boring position (FIG. 4) and the receiving position above ground.

In the case of the boring device illustrated in FIG. 6, the rotary drive 10 is connected to a raising drive 22, which allows the rotary drive together with its receiving part 23 for the rear end of a rod section 11 to be displaced out of the boring position, in which it is aligned with the rod section 13 which is already in the ground, upwards into the position illustrated. In this position, it is possible for rod section 11 which is longer than the distance between the rotary drive 10 and the rear end of the rod section 14 which is already in the ground to be introduced into the receiving part 23.

The invention claimed is:

1. A method for producing and widening ground bores or for the destructive replacement of buried pipelines with the aid of a boring device which is arranged in a starting excavation and has a boring rod comprising a plurality of sections, characterized by moving not all the boring device, but rather the rotary drive for the advancement or at least part thereof which includes the receiving part for the rod sections, out of its boring position in the starting excavation, introducing or removing a rod section by moving at least the rotary drive with a rod receiving part out of its boring position at the starting excavation into a position which allows a rod section to be introduced into the rod receiving part from outside the starting excavation, and moving the rotary drive for the advancement or at least a part thereof which includes the receiving part for the rod sections back into the boring position after a rod section has been introduced or removed.

2. The method as claimed in claim 1, characterized by raising a rod receiving part of the boring device.

3. The method as claimed in claim 1, characterized by pivoting the boring device in the starting excavation into an inclined position about a rotation point located at the front or the rear.

4. The method as claimed in claim 1, characterized by moving the receiving part of the boring device for a rod section upward.

5. The method as claimed in claim 4, characterized by moving a rod receiving part of the boring device for a rod section upward.

6. The method as claimed in claim 1, characterized by pivoting the boring device out of its boring position into a receiving position in the starting excavation.

7. The method as claimed in claim 6, characterized by moving the boring device out of its receiving position in the starting excavation into a receiving or removal position outside the starting excavation and above ground.

* * * * *